United States Patent [19]

Dunstan

[11] Patent Number: 4,580,902

[45] Date of Patent: Apr. 8, 1986

[54] MIXING PLANT

[75] Inventor: Trevor G. Dunstan, Brisbane, Australia

[73] Assignee: Dunstan & Partners Pty. Ltd, Australia

[21] Appl. No.: 634,011

[22] Filed: Jul. 24, 1984

[51] Int. Cl.[4] ..... B28C 5/14

[52] U.S. Cl. ..... 366/33; 366/40; 366/42; 366/49

[58] Field of Search ..... 366/33, 34, 35, 30, 366/40, 49, 18, 19, 16, 21, 20, 177, 27, 41, 42, 66

[56] References Cited

U.S. PATENT DOCUMENTS

| | | | |
|---|---|---|---|
| 858,017 | 6/1907 | Pence | 366/35 |
| 2,877,524 | 3/1959 | Bishop | 366/19 |
| 3,198,494 | 8/1965 | Curran | 366/18 |
| 3,314,661 | 4/1967 | Franklin | 366/34 |
| 3,343,688 | 9/1967 | Ross | 366/18 |
| 3,917,236 | 11/1975 | Hanson | 366/49 |

*Primary Examiner*—Robert W. Jenkins

*Attorney, Agent, or Firm*—Sughrue, Mion, Zinn, Macpeak, and Seas

[57] ABSTRACT

A mixing plant suitable for mixing of particulate material of different densities such as road base materials with the addition of water or other liquid. The mixing plant includes a receptacle for particulate materials and a mixing station or pug mill. There is provided first conveying means suitably in the form of a conveyor belt for conveying particulate material from the receptacle to the mixing station. There is also provided a container for finely divided material which may act as a binding agent or stabilizer for the particulate material.

There is also provided a second conveying means such as a conveyor belt for conveying finely divided material to the mixing station. There is also provided means for adding water or other liquid to the finely divided material and the particulate material at the mixing station.

There is also provided a collection station or discharge station and means for transporting the mixed materials from the mixing station to the collection station.

Preferably this is in the form of an elevator conveyor which extends upwardly from the mixing station.

13 Claims, 10 Drawing Figures

MIXING PLANT

This invention relates to a particulate mixing plant suitable for mixing together of mixtures of particles of different sizes and/or densities optionally with the addition of water or other liquid so as to make a resulting composition having desired properties which may be put to a particular purpose as may be required.

Generally the invention will be described in relation to mixing plants suitable for formation of a road making composition but it will be appreciated by those skilled in the art that the mixing plant of the invention may be utilized for preparation of compositions of particulate materials useful for general industrial applications such as in the food industry, building industry or in the manufacture of detergents and lubricants.

Roads are constructed largely from naturally occuring materials which include crushed rock and various natural soils. The task of the roadbuilder is to turn a heap of loose granular material into a solid load bearing traffic carrying platform. For this to be achieved it is necessary for particles of graded sizes to be accurately spread and compacted to maximum density. It is normal for materials to be brought to optimum moisture content before their placement and compaction. This causes a reduction in interparticle friction and allows the consolidation of the materials to a solid bed.

In many instances the availability of suitable high grade crushed rock materials is restricted. It therefore is becoming increasingly necessary to make use of second grade material and to improve their strength, alter the plasticity of their fines and clay content or to alter their water porosity characteristics by the addition of suitable treatment agents such as cement, cement/flyash blends or hydrated lime.

The above described material modification was usually done in a fixed mixing plant or by means of a tractor mounted heavy duty rotary hoe or similar device.

Also traditionally water has been added to roadmaking materials prior to compaction by means of a water truck fitted with a spraying system. Since the water or moisture was added from the top down it usually affected the distribution of the fines within the material and rarely led to uniform moistening. On the other hand the compactability of such material is extremely sensitive to moisture content and areas of inadequate moisture generally were not properly compacted while those portions which were excessively wet collapsed and lost dimension.

Non uniformity of material leads to premature road failure. It was not uncommon in the past for materials to be spread in wide rows with graders and turned and mixed with the graderblade repeatedly before they were able to be properly spread and rolled. If road base materials are accurately moisturised they are able to be placed with modern high compaction paving machines thus eliminating the need for grader mixing and spreading. However, this has not been the case previously.

Conventional mixing plants which have been used previously for roadmaking in combination with a pavement machine have comprised a loading hopper for aggregate or road base materials, an elevator or conveyor for transporting the road base materials to a mixer wherein water was also added so as to provide a composition which could then be compacted. In this conventional mixing plant while it was mobile in that it was supported by ground engaging wheels there was no provision for the addition of filler or binding agent such as cement, flyash or hydrated lime which acted to stabilize the road making base compositions which included tar, sand screenings or stones etc.

Another problem was that when the compositions were transported by conveyor to the mixer they were open to atmosphere creating a dust problem and also a certain amount of loss of material until water was added to the composition in the mixer.

Also if filler or binding agent was to be added to the roadmaking base compositions this would have necessitated the use of a stationary hopper which would have had to be used in conjunction with the mobile mixing plant previously described. This provided a bulky and expensive system in relation to manufacture of the roadmaking base compositions prior to compaction.

It therefore is an object of the invention to provide a mixing plant which alleviates the abovementioned problems associated with the prior art.

The invention provides a mixing plant suitable for mixing of particulate materials of different densities with the addition of water or other liquid comprising (i) a receptacle for particulate materials;
(ii) a mixing station;
(iii) first conveying means for conveying said particulate materials from the receptacle to the mixing station;
(iv) a container for finely divided material capable of acting as a binding agent or stabilizer for the particulate material;
(v) second conveying means for conveying said finely divided material to the mixing station;
(vi) means for adding water or other liquid to the finely divided material and the particulate material at the mixing station;
(vii) a collection station; and
(viii) means for transporting the mixed composition from the mixing station to the collection station.

The receptacle for the particulate material may be open topped and suitably may be V shaped or part conical in shape. It may include an outlet in a base wall thereof for transfer to the first conveying means.

Preferably there is provided gate means which is associated with the receptacle outlet for regulating or controlling the particle size in the particulate material. This may be of any suitable type and in one form may include a gate member attached by link arms to a support axle which may adjustably provide a gap or clearance between the conveyor belt and the gate member which constitutes a preferred form of first conveying means which is directly in the path of the particulate material as it transferred thereto from the receptacle.

The conveyor belt may have a drive roller at one end and idler roller at the other and may be driven by any suitable means.

The container for finely divided material or fines may also have an open top and may have any suitable shape. Preferably it has a much greater volume than the receptacle and may also have an outlet in the base wall thereof for transfer of the finely divided material to the second conveyor means which preferably also comprises a conveyor belt of the same type as described above for the first conveying means.

Preferably the second conveying means is such as to feed finely divided material to the mixing station in metered amounts.

The mixing station or zone may include a housing which supports one or more shafts having paddles or agitator elements attached thereto wherein the or each shaft may again be driven by any suitable means. Preferably the or each shaft may include a plurality of radially oriented arms which support the agitator elements.

Preferably the means for adding water or other liquid to the material at the mixing station may comprise a spraybar having a plurality of jets wherein water may be sprayed onto the material being mixed. However, this may be replaced in another form by a series of jets or holes in the walls of the housing from which water may be conveyed thereto from a water tank which may be separate from the receptacle for the particulate material but more preferably may comprise part thereof surrounding the interior of the receptacle.

The means for transporting the mixed material from the mixing station to the collection station may be any suitable type but preferably includes an elevator conveyor having a drive roller and plurality of idler elements. Suitably the elevator conveyor may extend upwardly from the mixing station to the collection station.

The collection station suitably comprises a container suitably having an inlet or open top and which is provided with gate means in association with an appropriate outlet which may open at predetermined intervals so as to prevent or inhibit segregation of the mixed material so that it may all be uniformly consistent prior to its end use.

Suitably the mixing plant is mobile and to this end the components (i) to (viii) above may be supported on a single chassis having ground engaging wheels. There also may be provided means for converting the mixing plant from an operational mode to a transportable mode wherein the elevator conveyor and the container for finely divided material may be pivoted or moved from an extended position in the operational mode to a retracted position in the transportable mode.

Reference may now be made to a preferred embodiment of the invention as shown in the attached drawings wherein.

Figure 1:
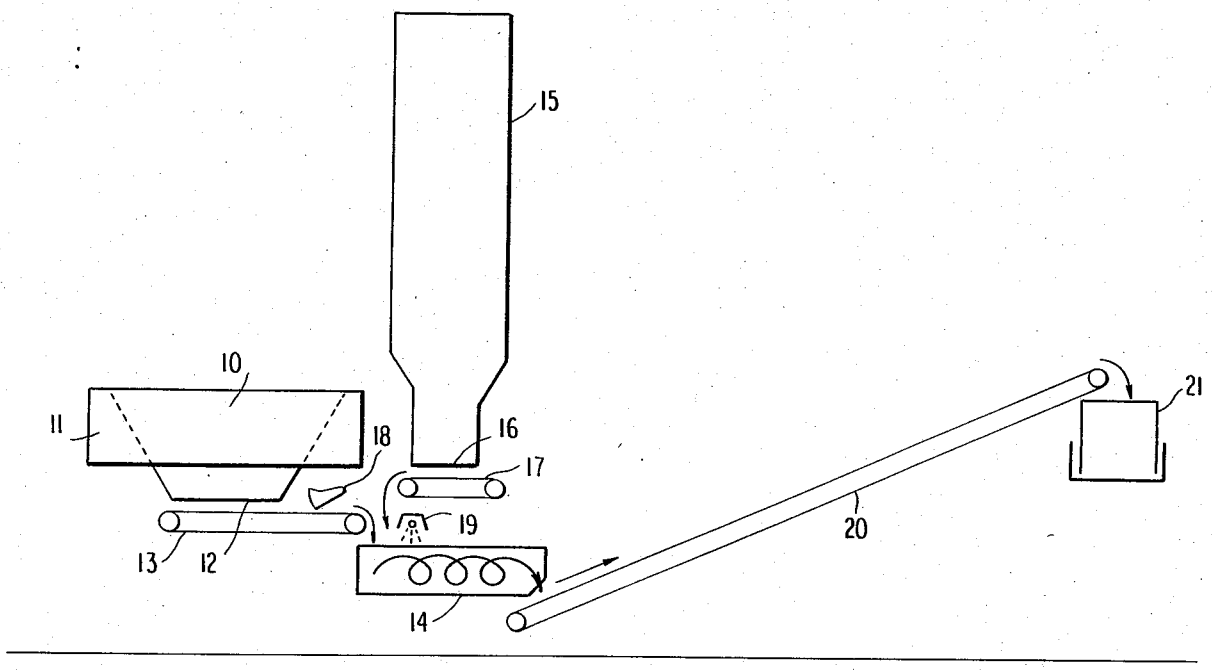
FIG. 1 is a schematic outline of a mixing plant constructed in accordance with the invention showing the inter-relationship of each component thereof to each other.

In the drawings and in particular in FIG. 1 there is shown receptacle 10 for particulate material, water storage tank 11, outlet 12 of receptacle 10, conveyor belt 13 for conveying particulate material to mixing station 14, container 15 for finely divided material, outlet 16, conveyor 17 for transporting finely divided material to mixing station or zone 14, gate member 18, water spraybar 19 and elevator conveyor 20 for transferring material to collection station 21.

Figure 2:
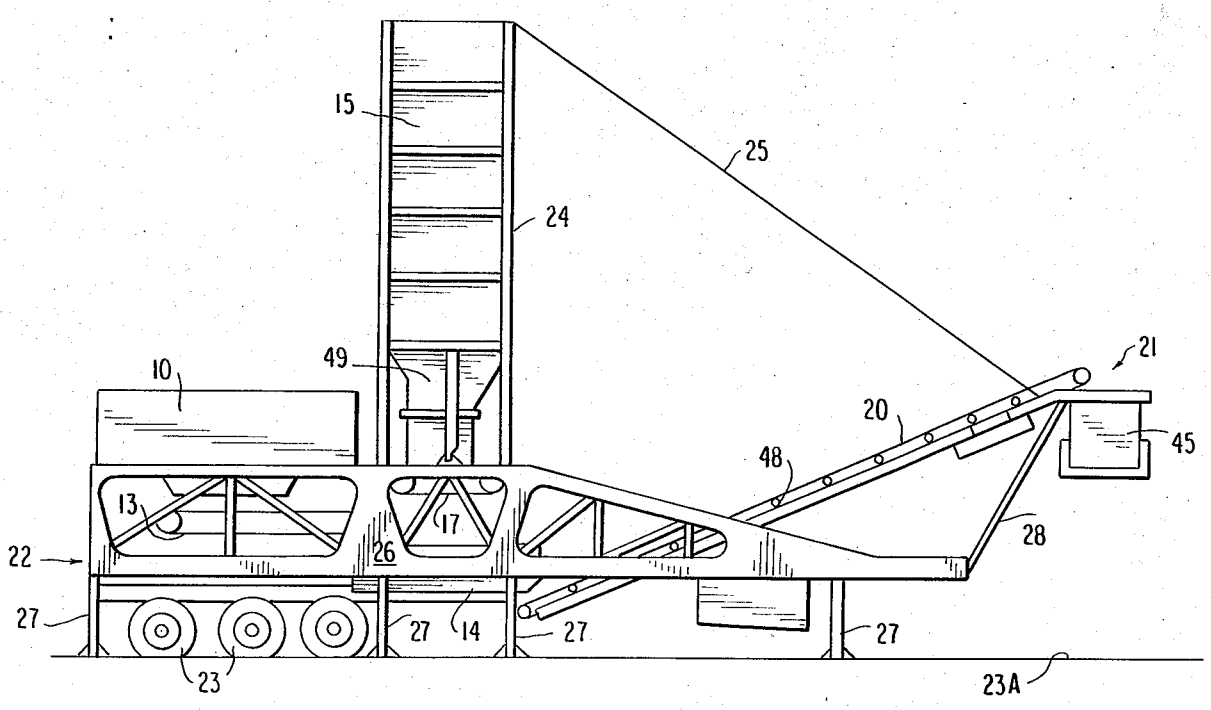
FIG. 2 is a side view of the mixing plant of FIG. 1 in the operational mode.
Figure 3:
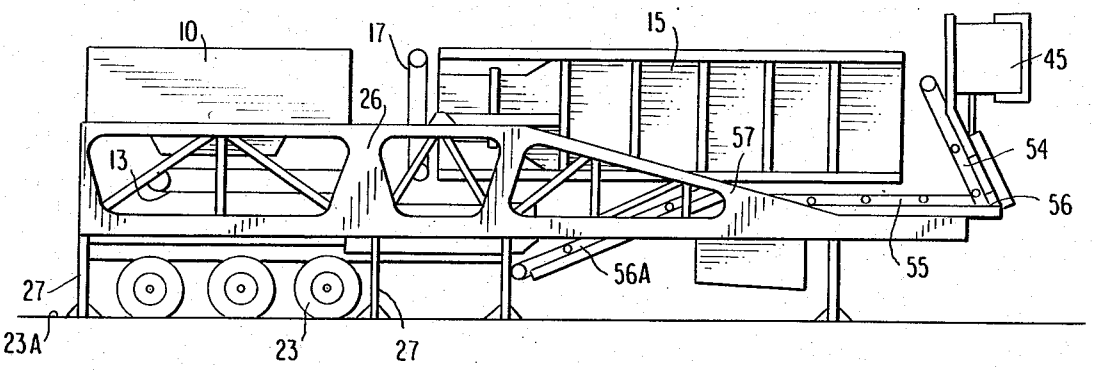
FIG. 3 is a side view of the mixing plant of FIG. 1 in a transportable mode.

In FIGS. 2–3 there is shown also chassis 22 for supporting the components described in FIG. 1 having ground engaging wheels 23 supported on ground 23A. There is also shown container support frame 24, support ties 25 interconnecting container 15 and elevator conveyor 20, chassis frame side member 26, support legs 27, support frame 28 interconnecting chassis 22 and elevator conveyor 20.

Figure 4:
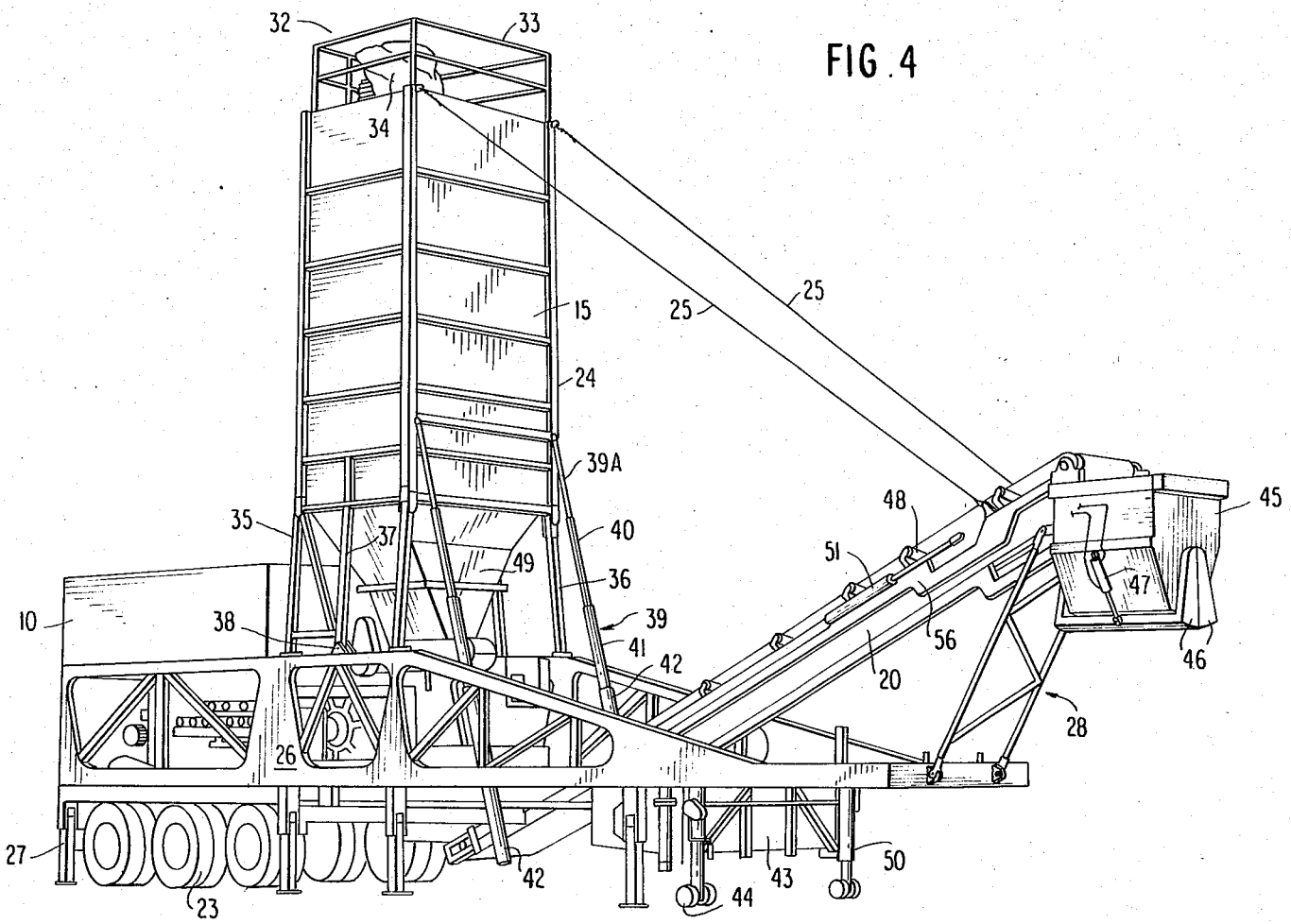
FIG. 4 is a perspective view of the mixing plant of FIG. 1 in the operational mode.

In FIG. 4 there is shown inlet 32 for container 15, inlet frame 33, hollow bag 34 associated with inlet 32 for passing finely divided material into container 15, fixed front prop legs 35 for container 15, rear prop legs 36 of container 15 pivotally attached thereto, support arms 37 of container 15 hingedly attached to chassis 22 at 38, hydraulic ram assemblies 39 having telescopic sections 39A, 40, 41 and 42, water storage tank 43, dolly wheels 44, collection station 21 in the form of hopper 45 having exit gates 46, hydraulic ram assemblies 47 controlling opening of gates 46, idler rollers 48 for elevator conveyor 20, conical portion 49 of container 15, hollow legs 50 for dolly wheels 44 and hydraulic ram assembly 51 which controls pivotal movement of hopper 45 and a rear portio of elevator conveyor 20.

Figure 5:
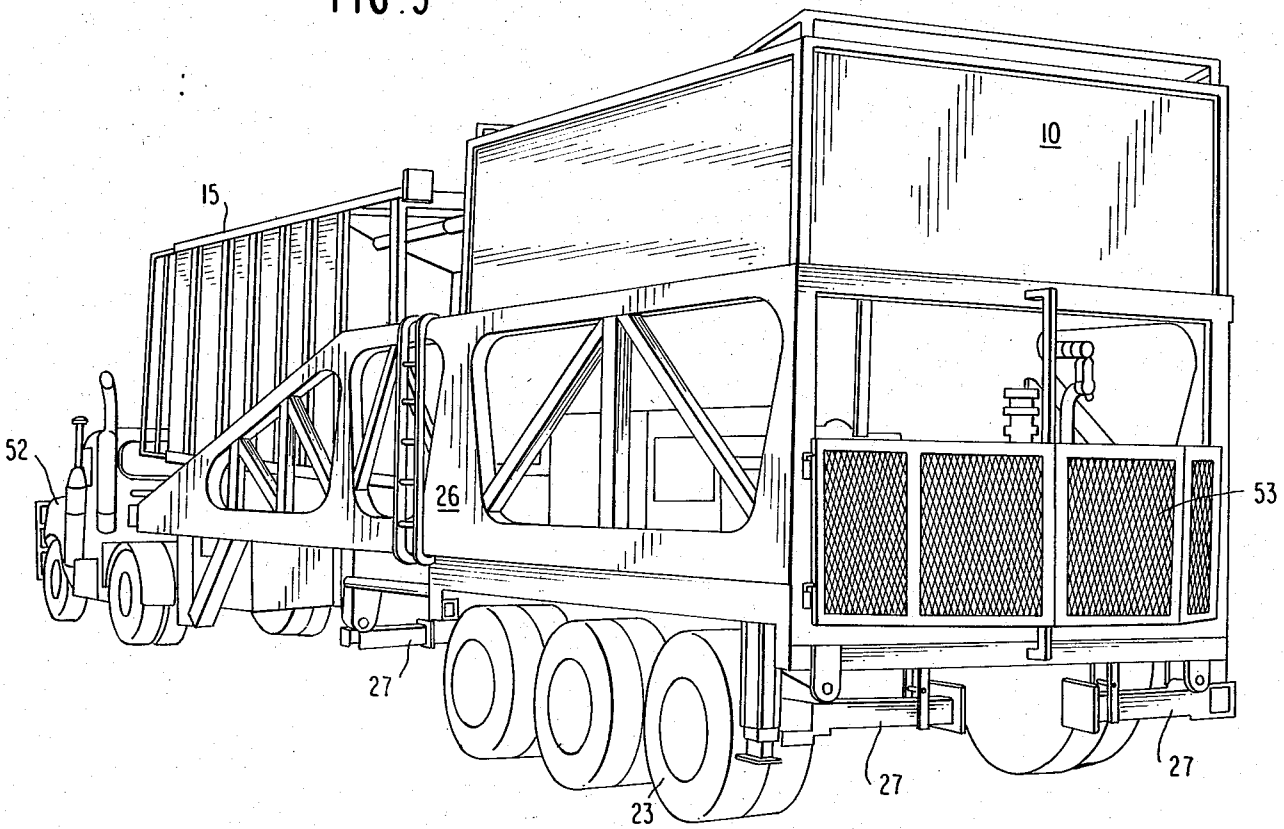
FIG. 5 is a perspective view of the mixing plant of FIG. 1 coupled to a prime mover and in the transportable mode.

In FIG. 5 there is shown prime mover 52 to which chassis 22 in the transportable mode is attached and diesel engine compartment 53. There is also shown support legs 27 folded underneath chassis 22.

In conversion from the operational mode to a transportable mode as shown in FIGS. 2–5, guy wires or ties 25 are disconnected and ram assemblies 51 actuated to pivot collection hopper 45 and rear portion 54 of elevator as shown from the position shown in FIG. 2 or 4 to the position shown in FIG. 3. Rear portion 54 of elevator 20 is pivotally attached to the remainder of the conveyor at 56. Support frame 28 is removed to enable pivotal movement of rear portion 54 of conveyor 20.

In relation to container 15, prop legs 36 fold transversely underneath container 15 in the same manner as support legs 27 and prop legs 35 remain fixed to container 15. Sections 39A, 40 and 41 of ram assembly 39 are retracted into base component 42 and container 15 tilted on arms 37 from the upright position shown in FIG. 2 to the horizontal position shown in FIG. 3. Conveyor 20 also comprises intermediate portion 55 and front portion 56A which are pivotally interconnected at 57 and these portions are pivoted with respect to each other to assume the attitude shown in FIG. 3. Dolly wheels 44 are also retracted into hollow legs 50.

Figure 6:
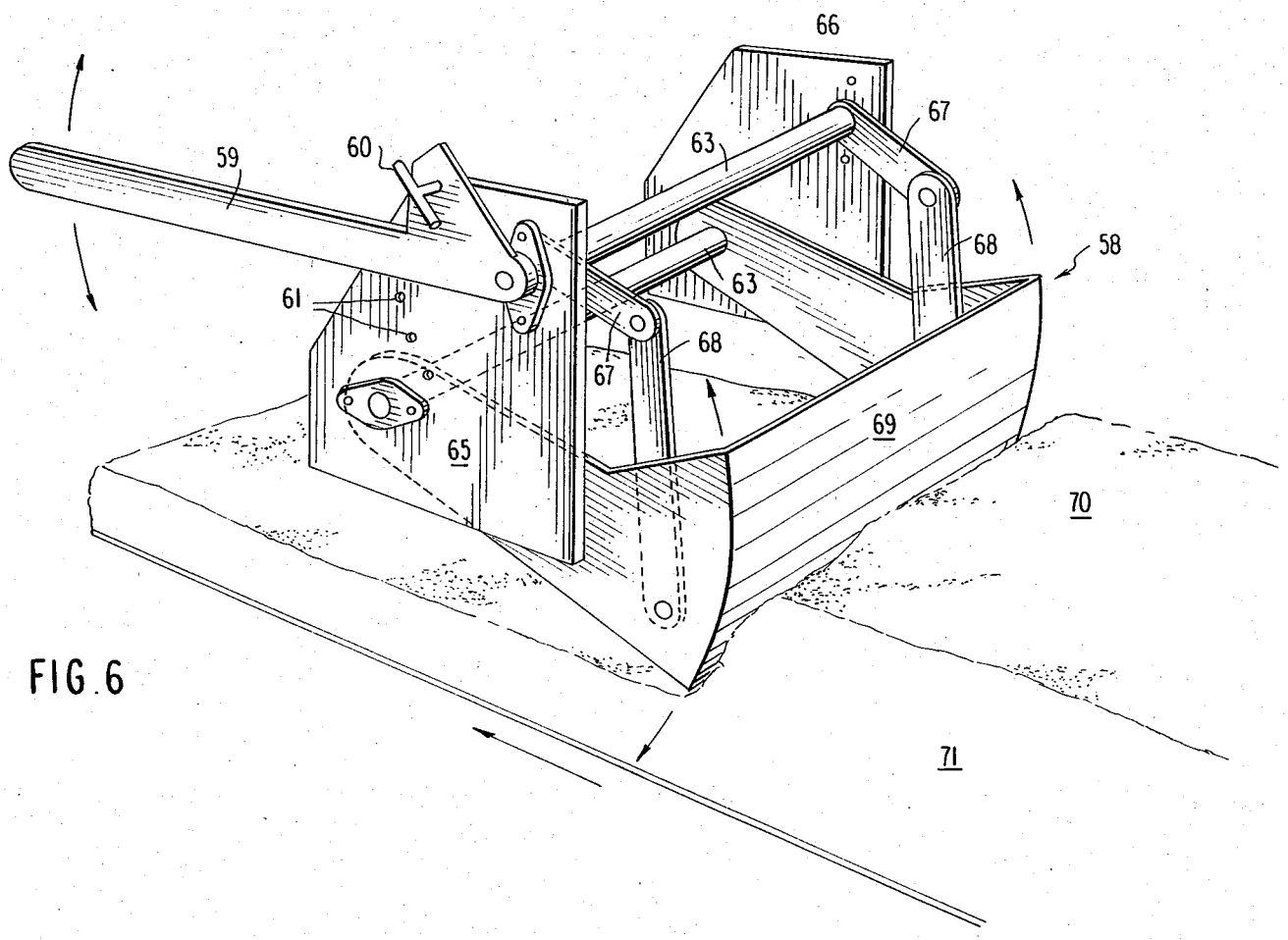
FIG. 6 is a perspective view of the gate means associated with the receptacle outlet.

In FIG. 6 there is shown gate mechanism 58 comprising adjustment handle 59, adjustment pin 60, adjustment holes 61, bearings 62, axle members 63, interconnecting cheek plates 65 and 66, link arms 67 and 68 and gate member 69. Upon actuation of handle 59 and pin 60 engaging a selected hole 61 gate member 69 may be elevated or lowered as required to vary the gap between the gate member 69 and conveyor belt 71. This mechanism is useful in that it enables the gap to be increased in the advent of larger particle size or to be decreased in the advent of smaller particle size.

Figure 7:
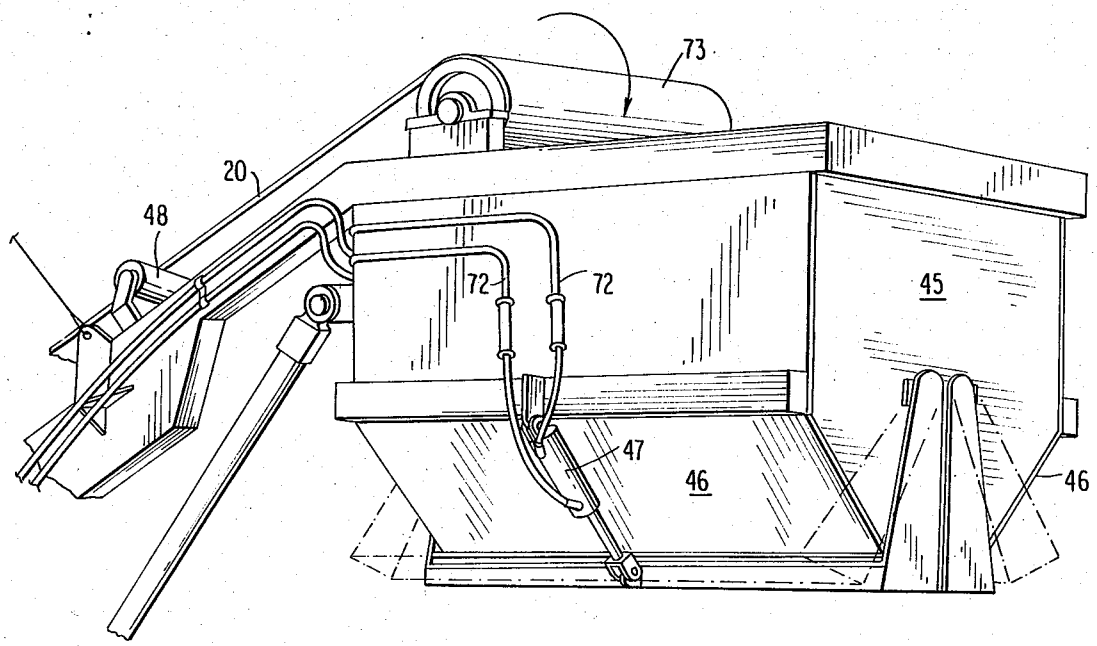
FIG. 7 is a perspective view of the gate means associated with the collection station.

In FIG. 7 there is shown collection hopper 45 having exit gates 46, hydraulic ram assemblies 47 controlling movement of gates 46 from a closed position shown in solid outline to an open position shown in dotted outline. This movement is controlled by an appropriate timing mechanism (not shown) to open at selected intervals to prevent separation of the mixed composition. There is also shown hydraulic hoses 72 and rear roller 73 for conveyor 20.

Figure 8:
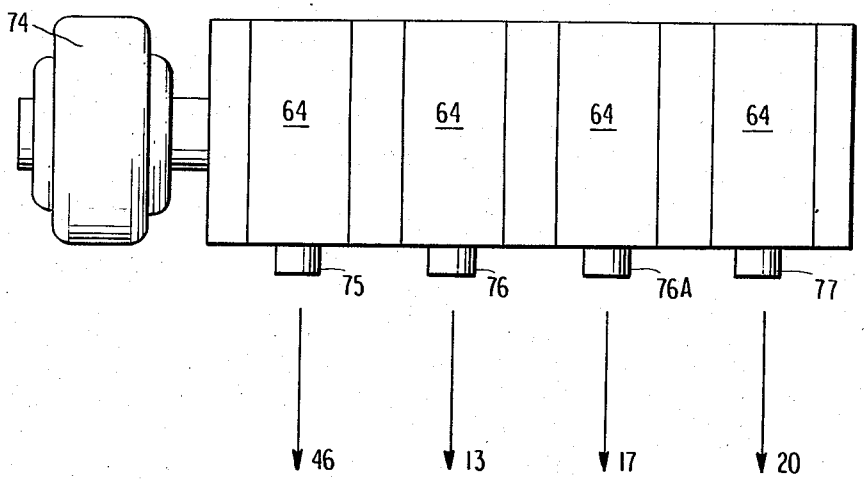
FIG. 8 is a schematic view of the drive means for driving the various components of the mixing plant of FIG. 1.

In FIG. 8 there is shown hydraulic motor 74 comprising fluid output 75 for drawing gates 46, fluid output 76 for actuating conveyor 13, fluid output 76A for actuating conveyor 20 and a water pump (not shown) and fluid output 77 for driving conveyor 20. There is also shown gear pumps 64 for driving fluid through outputs 75, 76, 76A and 77.

Figure 9:
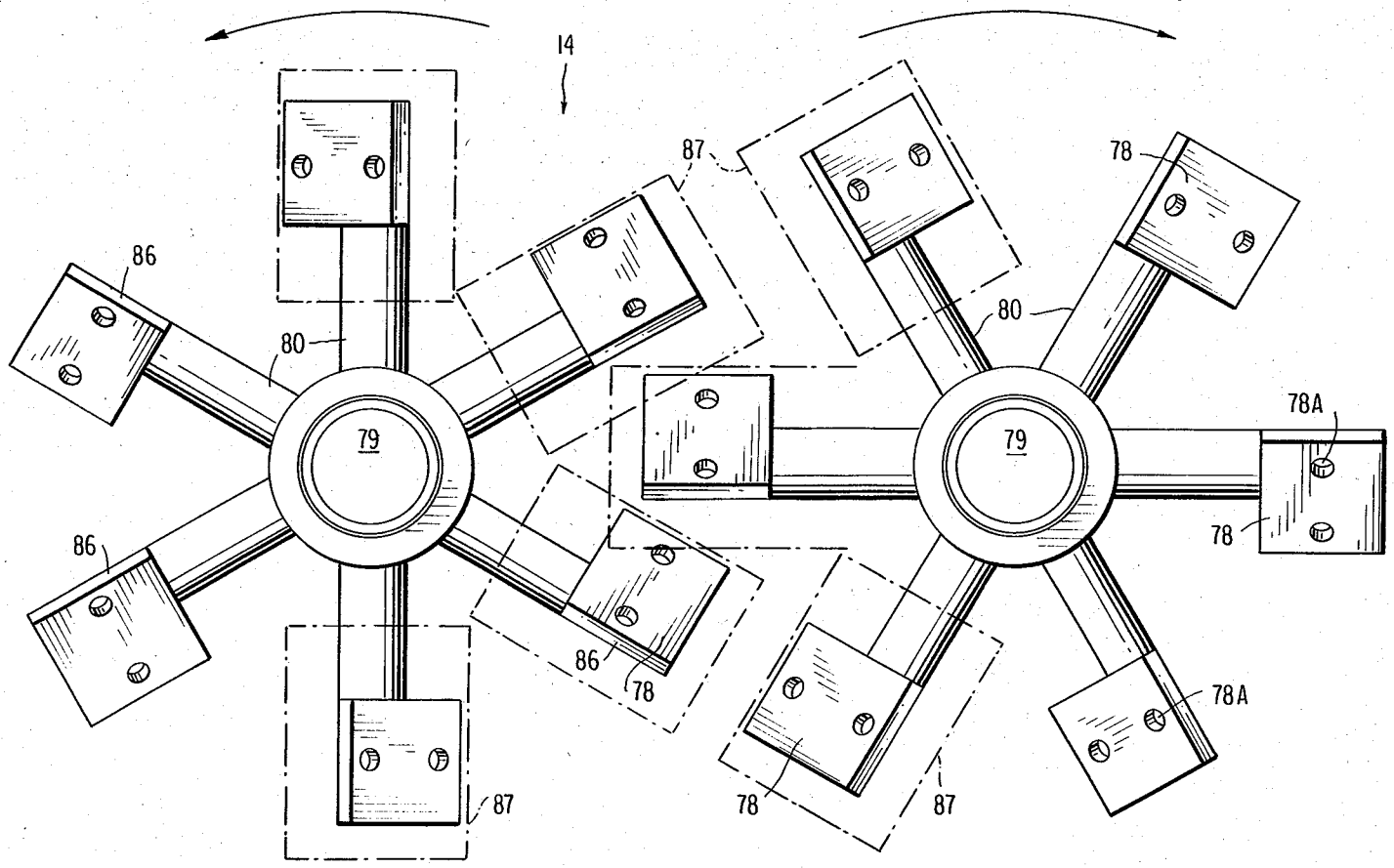
FIG. 9 is a side view of the mixing station showing the agitator elements and their associated support shafts.
Figure 10:
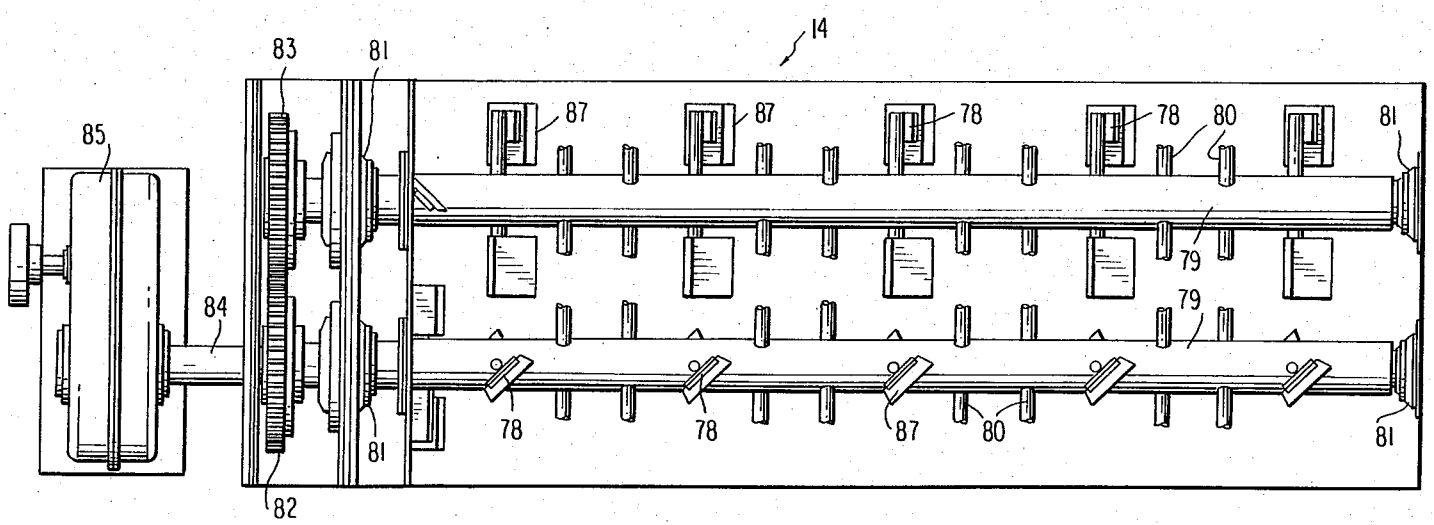
FIG. 10 is a top plan view of the arrangement shown in FIG. 9.

In FIGS. 9–10 there is shown mixing station or housing 14 comprising rotatably mounted support shafts 79 having radially oriented arms 80 having attached thereto paddle brackets 78 having attachment apertures 78A for paddles 87. There is also shown retaining lugs 86 of each bracket 78. Each shaft 79 is rotatably mounted in bearings 81 and there is also shown meshing gears 82 and 83 rotating in opposite directions. So as to drive shafts 79 gear 82 is attached to output shaft 84 of motor or engine 85.

It will of course be appreciated that the mechanical drive for the mixing housing 14 shown in FIGS. 9–10 may be replaced by a hydraulic drive if desired and thus shafts 79 may be driven through hydraulic motor 74 if desired.

It will be appreciated that the mixing plant of the invention has many advantages in relation to preconditioning or preparing roadbase materials prior to compaction, and thus allowing roads, pavements and the like to be prepared efficiently and inexpensively in combination with a pavement or compacting machine. Designed to blend water and particulate additives such as cement, lime or cement-flyash blends with granular pavement materials it allows such materials to have optimum moisture content and be mixed uniformly.

Having a machine which can be quickly and efficiently converted from a transportable mode to an operational mode and vice versa, the mixing plant can be relocated and set up allowing materials to be prepared at site prior to placement.

The hydraulically self erecting container and levelling legs described in the preferred embodiment and the working support legs may be extended or retracted efficiently and quickly. The same applies to the foldable conveyor. The mixing plant requires no jacks or cranes and may be converted to operational mode in a matter of minutes. The cement container 15 may be raised in position in minutes with the telescopic hydraulic ram assemblies 39 and the same applies to the elevator and discharge hopper 45. Water is stored on board the machine as discussed previously and has appropriate conduits (not shown) for delivery of water to spraybar 19.

Diesel engine 53 may be connected to hydraulic motor or pump 74 at one end and at the other and it may be coupled via a clutch (not shown) and belt drive to the gearbox comprising gears 82 and 83. In this latter form motor 85 may be omitted if desired.

I claim:

1. A mixing plant suitable for mixing of particulate materials of different densities with the addition of water or other liquid comprising (i) a receptable for particulate materials having an outlet;

(ii) a mixing station;

(iii) first conveying means including a conveyor belt for conveying said particulate materials from the receptacle to the mixing station and a gate member associated with the outlet of the receptacle which may be actuated to vary the gap or clearance between the gate member and the conveyor belt dependent upon particle size;

(iv) a container for finely divided material capable of acting as a binding agent or stabilizer for the particulate material;

(v) second conveying means for conveying said finely divided material to the mixing station;

(vi) means for adding water or other liquid to the finely divided material and the particulate material at the mixing station; and (vii) a collection station; and (viii) means for transporting the mixed materials from the mixing station to the collection station.

2. A mixing plant as claimed in claim 1 wherein each of components (i) to (viii) are supported on a mobile chassis having ground engaging wheels so that the mixing plant may have an operational mode and a transportable mode.

3. A mixing plant as claimed in claim 2 wherein the container for finely divided material is pivotally attached to the chassis so that it may assume a vertical orientation in the operational mode and a horizontal orientation in the transportable mode.

4. A mixing plant as claimed in claim 3 wherein the container is also supported by a hydraulically driven telescopic arm comprising two or more telescopic sections.

5. A mixing plant as claimed in claim 2 wherein the container is also supported by a plurality of foldable support legs in the operational mode.

6. A mixing plant as claimed in claim 2 wherein the means for transporting the mixed composition is an elevator conveyor extending upwardly from the mixing station and which also comprises two or more sections pivotally attached to each other whereby it may assume an extended orientation in the operational mode and a retracted orientation in the transportable mode.

7. A mixing plant as claimed in claim 2 wherein the chassis may comprise a plurality of support legs in the operational mode which are pivotally attached to the chassis but which are folded thereunder in the transportable mode.

8. A mixing plant as claimed in claim 2 wherein the means for adding water comprises a perforated spray bar which communicates with a water tank located on said chassis.

9. A mixing plant as claimed in claim 1 wherein the second conveying means is a conveyor belt which communicates with an outlet of the container.

10. A mixing plant as claimed in claim 1 wherein the mixing station comprises one or more rotatably mounted support shafts having agitator elements attached thereto which may extend at right angles to the axis of their associated shaft or be offset thereto.

11. A mixing plant suitable for mixing of particulate materials of different densities with the addition of water or other liquid comprising:

(i) a receptacle for particulate materials having an outlet;

(ii) a mixing station comprising one or more rotatably mounted support shafts having agitator elements attached thereto;

(iii) a first conveyor belt which communicates with the outlet of the receptacle for conveying particulate material to the mixing station;

(iv) a container for finely divided material capable of acting as a binding agent or stabilizer for the particulate material having an outlet;

(v) a second conveyor belt which communicates with the outlet of the container which conveys finely divided material to the mixing station;

(vi) means for adding water or other liquid to the finely divided material and the particulate material at the mixing station;

(vii) a collection hopper having exit gates pivotally mounted thereto which may open at periodic intervals of time; and (viii) a conveyor elevator for transporting the mixed materials from the mixing station to the collection station; wherein each of components (i) to (viii) are mounted on a mobile chassis having ground engaging wheels and components (iv) and (viii) may be operated to move from an extended position in an operational mode to a retracted position in a transportable mode.

12. A mixing plant suitable for mixing of particulate materials of different densities with the additional water or other liquid comprising:

(i) a receptacle for particulate materials;

(ii) a mixing station;

(iii) first conveying means for conveying said particulate materials from the receptacle to the mixing station;

(iv) a container for finely divided material capable of acting as a binding agent or stabilizer for the particulate material;

(v) second conveying means for conveying said finely divided material to the mixing station;

(vi) means for adding water or other liquid to the finely divided material and the particulate material at the mixing station;

(vii) a collection station; and (viii) means for transporting the mixed materials from the mixing station to the collection station wherein the collection station comprises a collection hopper having exit gates associated with an outlet thereof which may be opened by actuating means at predetermined intervals to inhibit segregation of the mixed material.

13. A mixing plant as claimed in claim 12 wherein the actuating means comprises hydraulic ram assemblies attached to the collection hopper.

* * * * *